US010081153B2

(12) United States Patent
Kling

(10) Patent No.: US 10,081,153 B2
(45) Date of Patent: Sep. 25, 2018

(54) FOLDING METHOD AND APPARATUS

(71) Applicant: Daniel H. Kling, New Hope, PA (US)

(72) Inventor: Daniel H. Kling, New Hope, PA (US)

(73) Assignee: FOLDSTAR, INC., Holmdel, NJ (US)

( * ) Notice: Subject to any disclaimer, the term of this patent is extended or adjusted under 35 U.S.C. 154(b) by 443 days.

(21) Appl. No.: 14/685,113

(22) Filed: Apr. 13, 2015

(65) Prior Publication Data

US 2015/0283782 A1 Oct. 8, 2015

Related U.S. Application Data

(63) Continuation of application No. 11/752,806, filed on May 23, 2007, now Pat. No. 9,005,096, which is a continuation-in-part of application No. 11/440,263, filed on May 23, 2006, now abandoned.

(60) Provisional application No. 60/683,689, filed on May 23, 2005, provisional application No. 60/803,000, filed on May 23, 2006.

(51) Int. Cl.

| | |
|---|---|
| ***B31F 1/20*** | (2006.01) |
| ***B31D 3/00*** | (2017.01) |
| ***B31F 1/00*** | (2006.01) |
| ***B65H 45/22*** | (2006.01) |

(52) U.S. Cl.

CPC ..... *B31F 1/20* (2013.01); *B31D 3/002* (2013.01); *B31F 1/0025* (2013.01); *B65H 45/228* (2013.01)

(58) Field of Classification Search

CPC .. B31F 1/20; B31F 1/0012; B31F 1/32; B31F 1/0025; B31F 1/22; B65H 45/20; B65H 45/18; B65H 45/16; B65H 45/22; B65H 45/228

USPC ..... 493/451, 356, 405, 463

See application file for complete search history.

(56) References Cited

U.S. PATENT DOCUMENTS

| | | | | |
|---|---|---|---|---|
| 9,005,096 | B2 * | 4/2015 | Kling | B31D 3/002 493/356 |
| 2002/0094926 | A1 * | 7/2002 | Kling | G06T 17/20 493/356 |

* cited by examiner

*Primary Examiner* — Michelle Lopez
(74) *Attorney, Agent, or Firm* — Fox Rothschild LLP

(57) ABSTRACT

A method and apparatus for forming patterns on sheet material are disclosed. The method comprises a continuous lateral stretch process for producing zero- or near zero-curvature structures. In a preferred embodiment, the method comprises pre-gathering the sheet material in the lateral direction to form longitudinal corrugated folds and then feeding the corrugated material through one or more sets of oscillating formers, preferably articulating discs, to impart folding in the lateral direction. Optionally, the sheet material may be fed through one or more sets of patterned rollers.

3 Claims, 12 Drawing Sheets

FOLDING METHOD AND APPARATUS

CROSS REFERENCE TO RELATED APPLICATION

This application is a continuation of U.S. patent application Ser. No. 11/752,806, filed May 23, 2007, (now U.S. Pat. No. 9,005,096, issued Apr. 14, 2015), which application is a continuation-in-part of U.S. patent application Ser. No. 11/440,263 filed May 23, 2006, which claims the benefit under 35 U.S.C. § 119(e) of U.S. Patent Application No. 60/673,689 filed May 23, 2005, both of which are hereby incorporated by reference on their entirety; and which claims the benefit under 35 U.S.C. § 119(e) of U.S. Patent Application No. 60/803,000 filed May 23, 2006, which is hereby incorporated by reference in its entirety

FIELD OF THE INVENTION

This application generally relates to a field of processing sheet materials. Specifically, this application relates to producing fine patterns on a sheet material having zero or near zero curvature.

BACKGROUND OF THE INVENTION

Sheet materials may be processed by several means such as stamping, joining cut pieces, thermoforming and folding. The folding process requires very little in-plane deformation of the sheet, and offers manufacturing advantages in many applications. The resulting surfaces may be modeled as zero curvature surfaces (Gauss curvature), with minor error due primarily to the radius of curvature along the fold creases.

Recently in U.S. patent application Ser. No. 09/952,057 filed Sep. 14, 2001 by Kling (hereinafter "Kling"), which is herein incorporated by reference, a vast array of doubly periodic folded patterns (DPFs) was invented that demonstrate diverse application for the DPF including for laminated core materials in rigid panels. Also processes for continuously producing DPFs have been disclosed in Kling. As sheet material may often be delivered in very long sheet on a roll, the advantages of the continuous manufacturing process for sheet materials include speed and economy. Several preferred machine designs will be discussed herein.

There are two general methods for continuous no-stretch processes for producing zero-curvature structures, namely, a gradual folding technique and a bunch and crunch technique.

To design the gradual folding process one may take a long folded sheet of the desired geometry, and unfold one end by pulling apart the pattern while applying force to flatten it. This may be done either by actual experiment or by calculation or by simulations. FIG. 1 shows a numeric estimate of such a partially folded DPF. The folding pattern is then sampled at incremental positions, starting with the flattened end and proceeding to the fully folded end. Rollers pairs with the pattern negatively imprinted on them in each of these positions are arranged in analogous sequence as shown in FIG. 2. Alternatively stamping dies in the sampled patterns may be positioned in sequence. The material is fed through. Potential problems with this method include the difficulty in changing tooling for new product specifications and the length of the roller sequences needed to draw the material in laterally.

The bunch and crunch method is designed by taking a folded sheet in the desired specification, measuring the lateral contraction ratio, designing a pre-gathering (bunching) method for giving the sheet longitudinal corrugations with the same lateral contraction ratio as the desired folded pattern, and designing pattered rollers with the folded sheet negatively engraved on them, and linking these so the corrugated material with the same contraction ratio of the folded sheet is fed through the patterned rollers. Note the final roller in the bunch and crunch method has the same geometry as the final roller in the gradual folding method, namely the roller is a circumferential expression of the desired pattern.

One problem with the bunch and crunch method is related to the longitudinal (machine direction) movement of the sheet as it is folded in the rollers. The material does all of its longitudinal contraction in the transition zone that extends from just before it is fed into the rollers to approximately the midpoint between the rollers on the plane containing their two axis.

The contact between the extreme edge of the teeth of the roller and the local position on the sheet will be discussed. In the plane containing the two roller axis the teeth extreme edges move nearly tangentially to the crease position. A schematic is shown in FIG. 3 and FIG. 4. In the FIG. 4, which represents the sheet in an enlarged view of FIG. 3, the dotted line represents the midplane containing the rollers' axis. One should note that the spacing between the crease points in the sheet changes as the sheet advances toward the midplane. The segments in the zig-zag line are different lengths until it meets the midplane. This means the crease locations in the sheet relative to the sheet roll or migrate through the sheet. Without in-plane distortion in many cases it is actually impossible for the sheet to slide over the successive teeth to reach the desired folded pattern because of the friction in the rollers and the difficulty in having creases migrate through the sheet material. As explained in Kling, the sheet was pre-gathered, to eliminate the problem of lateral teeth slippage over the roller teeth, but the longitudinal slippage problem still remains. In metals for instance, forcing excessive migration of creases under tension generally damages the sheet, especially at the fold vertices, and often the depth of the pattern must be severely limited to avoid punctures or tears.

With these two methods as backdrop, we describe first an improvement to the roller design in U.S. patent application Ser. No. 10/755,334 filed Jan. 13, 2004 by Kling, Basily and Elsayed (hereinafter "Kling et al."), which is incorporated herein by reference, to resolve the longitudinal slippage problem, and then several new machines designs and processes are described.

SUMMARY OF THE INVENTION

A method and apparatus for forming patterns on sheet material are disclosed. The method comprises a continuous lateral stretch process for producing zero- or near zero-curvature structures. In a preferred embodiment, the method comprises pre-gathering the sheet material in the lateral direction to form longitudinal corrugated folds and then feeding the corrugated material through one or more sets of oscillating formers, preferably articulating discs, to impart folding in the lateral direction. Optionally, the sheet material may be fed through one or more sets of patterned rollers.

DETAILED DESCRIPTION OF ILLUSTRATIVE EMBODIMENTS

I. Roller Designs for Fine Patterns

There is a difficulty in using rollers for folding processes that do not force the sheet to stretch greatly in the longitudinal direction. The difficulty is that for rollers with many circumferential periods, the proportions near the tangential region are such that many teeth of the roller engage the sheet material simultaneously. As the teeth go deeper into the sheet region, the sheet contracts in the longitudinal direction, to greater extent the deeper the teeth are engaged. However by tangent approximation, the teeth spacing in the longitudinal direction remains constant. Thus, there is a relative velocity in the longitudinal direction between the roller and the sheet, that changes according to how close the sheet is to the mid plane and to how far the roller teeth are engaged in the sheet. The larger the roller circumference is to the period length, the more teeth the sheet will have to slide over due to this relative velocity.

I have found that the roller composition and the pattern orientation also effect the material's ability to slide longitudinally within the meshing gears. In Kling et al., the figure showing the patterned rollers uses rubber rollers with the ridges extending laterally across the roller face. I have found that it is preferred that the rollers be made of hard material of low friction coefficient, preferably a metal alloy, and preferably steel or hardened steel. This promotes slippage between the sheet and the roller teeth and gives the roller a longer wear cycle. I have also found it is preferable for the row ridges on the face of the roller to extend circumferentially around the roller as in FIG. 5, instead of having the row ridges extend laterally along the face of the roller as in the figure in the Kling et al. patent. This enables easier slippage and also promotes the fold formation in the transition zone be simplifying the pre-convexity sequence required to form the fold. In practice the fold migration into the oncoming sheet is natural for the row ridge orientation going around the rollers, and not feasible for even moderate depth folding patterns in the orientation pictured in Kling et al.

Figure 6:
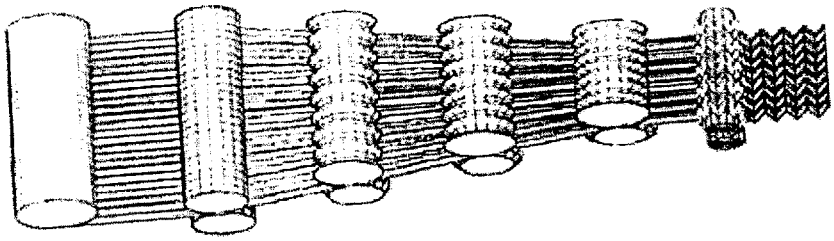
FIG. 6 shows an embodiment where the sheet material is longitudinally corrugated using sequential rollers.

The Kling et al patent application employs a center out 1, 3, 5, . . . method of pre-gathering the sheet into longitudinal corrugation. As there is a roller above and below the sheet, this means they have at least one roller for each flute in the corrugation. I have found this burdensome, and prefer a method that develops several flutes simultaneously. I further prefer a method that develops all flutes simultaneously. FIG. 6 shows a preferred method using sequential rollers. Other state of the art methods for producing longitudinal corrugation that develop several or all flutes simultaneously may be used the present invention.

Figure 1:
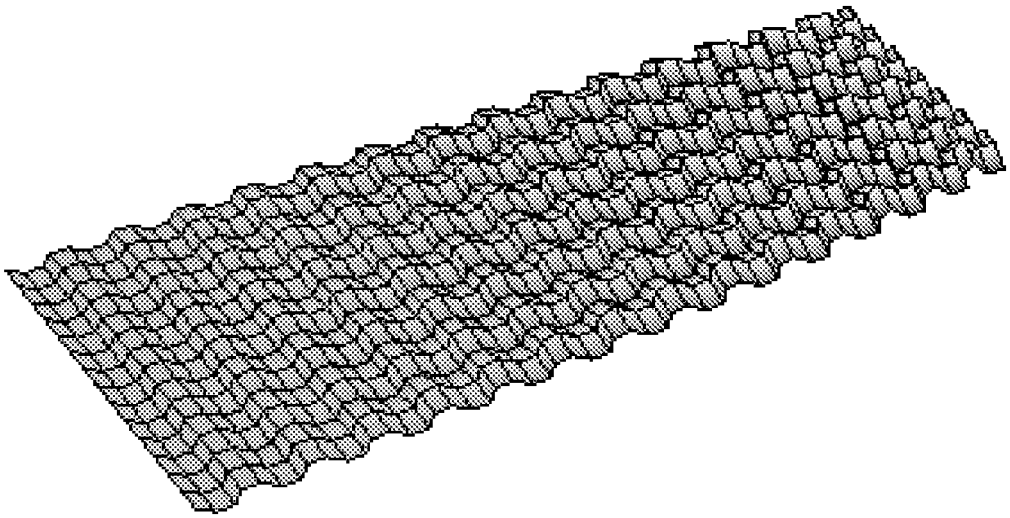
FIG. 1 shows a numeric estimate of such a partially folded DPF.
Figure 2:
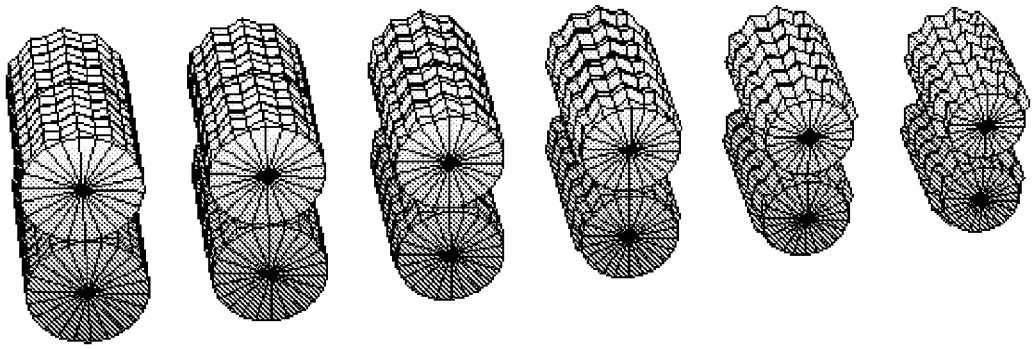
FIG. 2 shows rollers pairs with the pattern negatively imprinted on them in each of these positions are arranged in analogous sequence.
Figure 3:
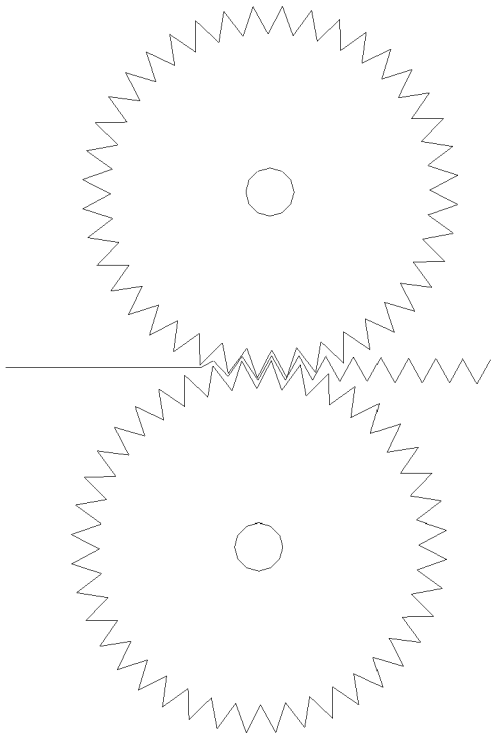
FIG. 3 illustrates that the extreme edges of the teeth of the rollers move nearly tangentially to the crease position.
Figure 4:
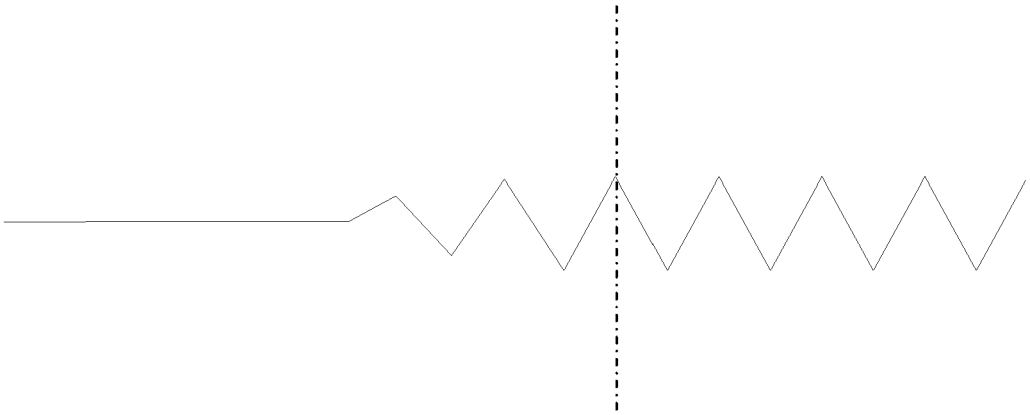
FIG. 4 illustrates the distortion of the crease formed in the sheet material as it is moved along the rollers of FIG. 3.
Figure 5:
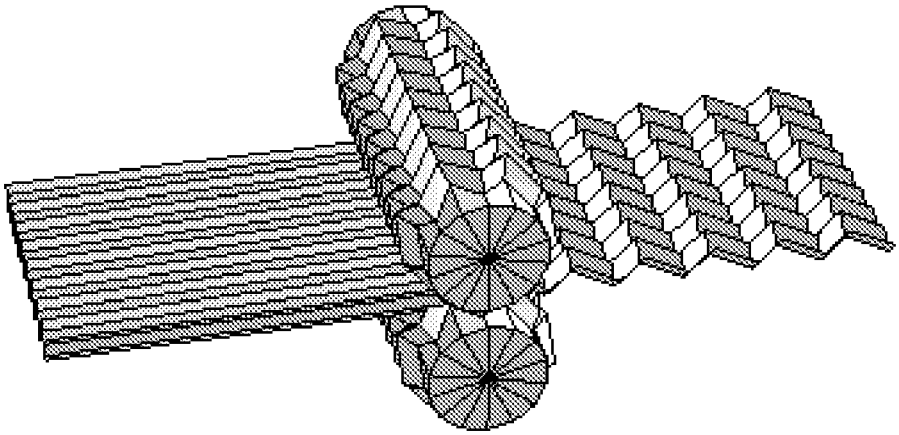
FIG. 5 shows an embodiment of the invention where the row ridges on the face of the roller extend circumferentially around the roller.

I have also found that it is preferred that the number of fold edges in one chain going around the roller should be preferably less than 50, and preferably less than 30 and preferably less than 20. FIG. 5 shows a roller with 14 fold edges in each circumferential row chain.

It is also preferable that the lateral length of the roll be close to or greater than the roll circumference. It may be desirable to use backer rolls or similar state of the art methods for keeping the rollers from deflecting.

For patterns that are very fine relative to the width of the sheet, keeping the number of periods around the roller will give a long slender roller. The finer the pattern, the more difficult to keep this roller from deflecting during operation. The problem is solved here for these folding, zero-curvature, or near-zero-curvature uses, by several means such as single backer rollers and double backer roller or similar state of the art methods for keeping the rollers from deflecting.

II. Continuous No-Stretch Processes for Producing Zero-Curvature Structures

A machine, and corresponding method, is described that alternative to either the bunch and crunch or the gradual folding processes. The folded material is selected. Rolled sheet is longitudinally pre-gathered (by any of the numerous means possible) with the same contraction ratio as the selected folded material. Then two or more folding stages are introduced. The final stage may be a roller pair with the pattern negatively engraved on it. The previous stage may also be a roller pair with a roughly similar design, however its geometry is preferably calculated by a method distinct from both state of the art methods above.

The calculation may be done as follows: The desired folded sheet has been selected. The pre-gathering profile is selected with the same (lateral) contraction ratio. The crease tessellation pattern is drawn on the unfolded sheet. This tessellation is examined on the pre-gathering profile. As the folding process contracts the sheet both longitudinally and laterally, and the pre-gathered material only contracts the tessellation in the lateral direction, the approximate parallelogram (or other) shape on the pre-gathered material will be longer longitudinally than the folded sheet. A series of rollers (at least two pairs) may be designed so that the final roller imitates the final folded sheet, the earlier patterned rollers have the same lateral dimensions as the final roller, but incrementally progress in their circumferential proportions from the long parallelogram on the pre-gathered corrugation material to shorter circumferential proportions on the final roller. Preferably, the crease vertices on the sheet, as it transforms from corrugation to folded pattern, migrate minimally in the longitudinal direction.

Figure 7:
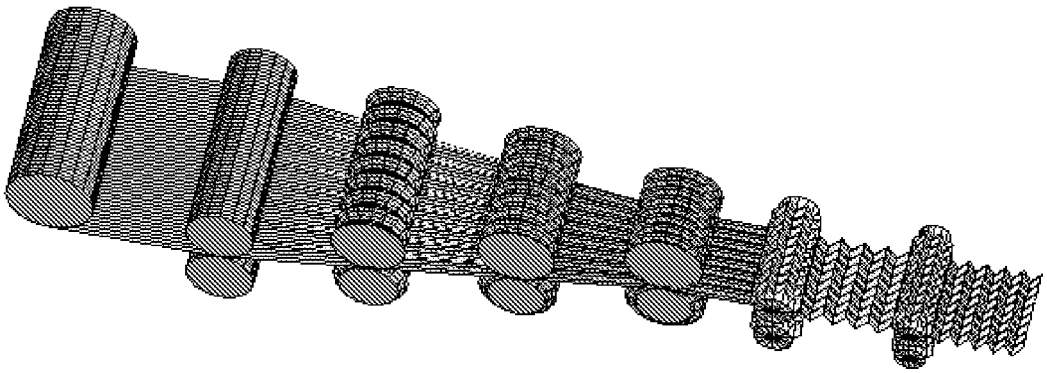
FIG. 7 shows an embodiment of the final DPF pattern implementation through a two-step patterned roller sequence.

As forming the longitudinal corrugation is a convenient way to contract the material laterally, it is preferred to do before the cross-folds are started and the resulting longitudinal indexing in the rollers required. After the pre-gathering is completed, or nearly completed, the cross-folding may be done with an economy of tooling. Here I have described how one may design a two or more step roller sequence to perform the cross folding. It should be note also that, as the fold creases get "dented" into the corrugated sheet to deeper depths, the period length will shorten longitudinally. Also, curved creases and other phenomenon will adjust progressively until they become the final folded pattern. This complicated geometry is a preferred material flow, and dies or rollers or articulating or other devices preferably implement the geometry with matching structure. FIG. 7 shows the final DPF pattern implementation through a two-step patterned roller sequence.

III. Continuous Folding Machine Articulating Discs

Figure 8:
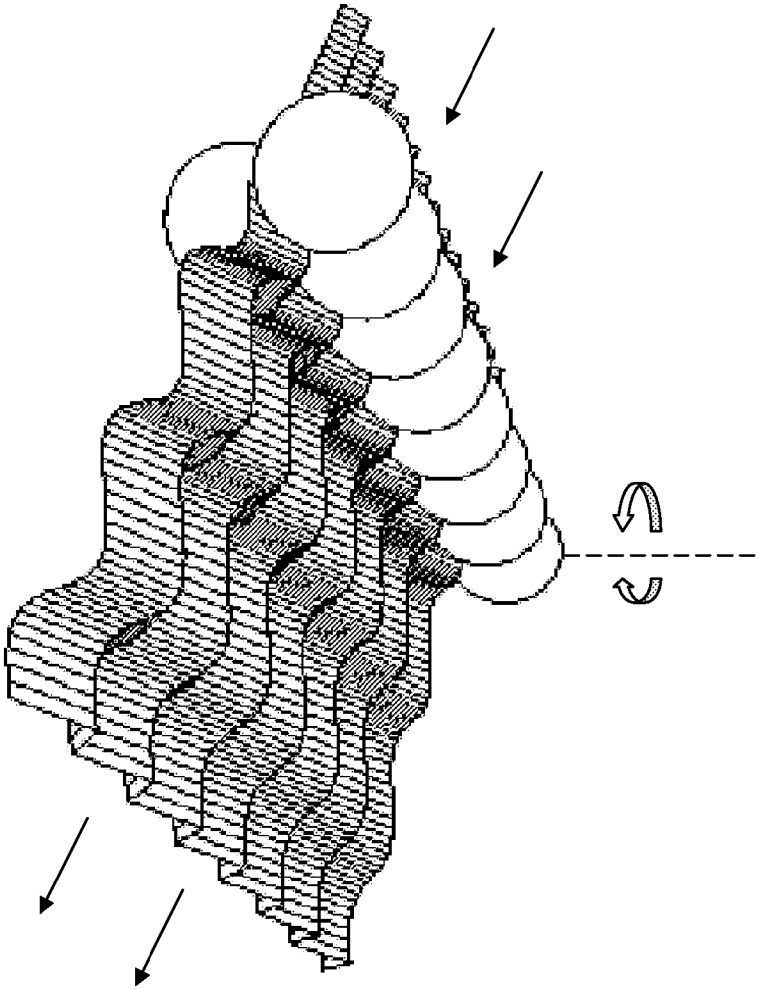
FIG. 8 shows an embodiment of the invention where longitudinally corrugated sheet material is shaped by two racks of articulating discs.
Figure 9:
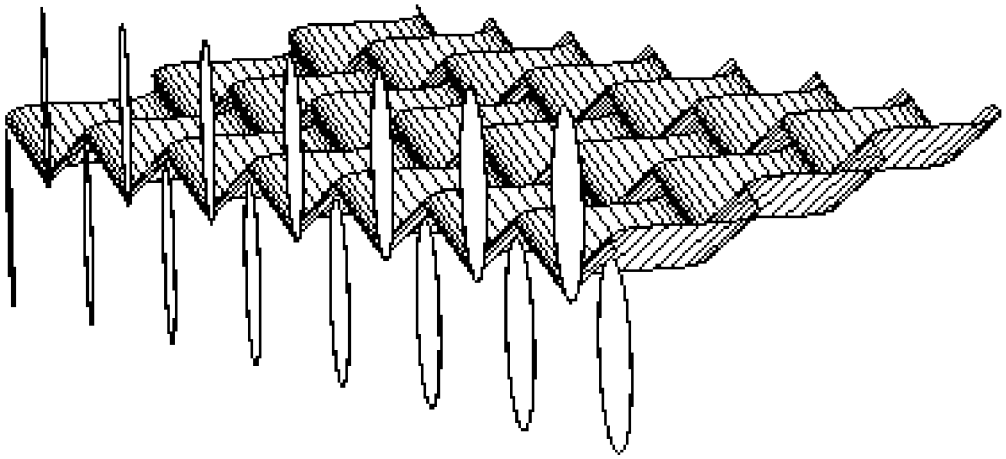
FIG. 9 is a side view of the embodiment illustrated in FIG. 8.

This machine resolves the longitudinal slippage problem over multiple roller teeth by another means, and may be used as a stand-alone or in conjunction with the patterned rollers. Rolled sheet material may be fed through a series of operations to continuously produce many of the common DPF structures. First the material is corrugated longitudinally. This is also called bunching the sheet and pre-gathering the sheet. This can be done by any of many state of the art techniques. The material may be pre-gathered to the approximate same contraction ratio as the final folded sheet. The material then feeds through two sets of facing parallel racks of articulating formers, preferably discs, as shown FIG. 8. As these discs oscillate, they impart an approximate sine wave into the folded sheet. The sheet if desired may be used as a rough-out and then fed through one or more sets of secondary rollers imparting a polygonal or other DPF pattern.

This procedure has many advantages over Kling's prior machine design. The oscillating rollers may have flat or grooved rollers backing them on the other side or the sheet, and the entire assembly may oscillate laterally in synchronization, enabling controlled positioning of the crease on both the sheet geometry and the position in three-space. The procedure accommodates a more diverse range of sheet materials. Also, for producing sine cores and similar materials, one machine could produce multiple scales and varieties by simply changing settings.

Figure 10:
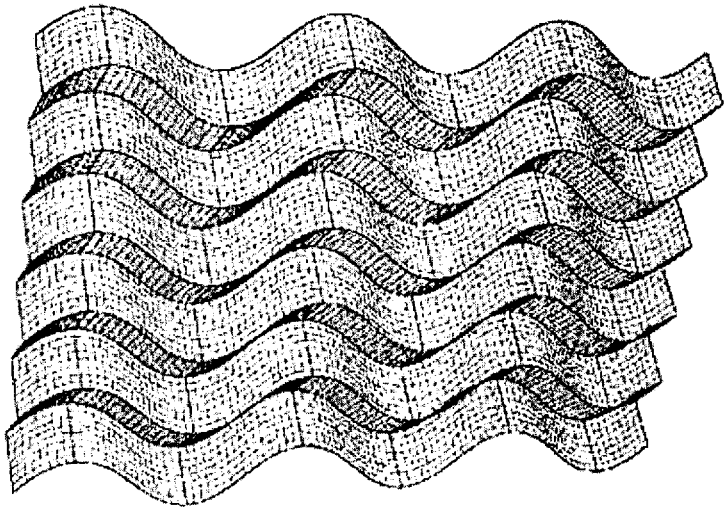
FIG. 10 shows a sheet material produced by an embodiment of the invention, where the secondary shaping is completed by a stamp.

The oscillating discs are also valuable as a preliminary step before patterned rollers. In this case, the discs rough out the pattern, generally accomplishing most of the longitudinal contraction prior to the patterned rollers. The patterned rollers then impart the more precise crease locations, and as the sheet was pre-processed by the oscillating discs, the problem of longitudinal slippage over multiple teeth is overcome. FIG. 10 shows the method where the secondary shaping is completed by a stamp. It is further preferred to use patterned rollers for this secondary operation.

Figure 11:
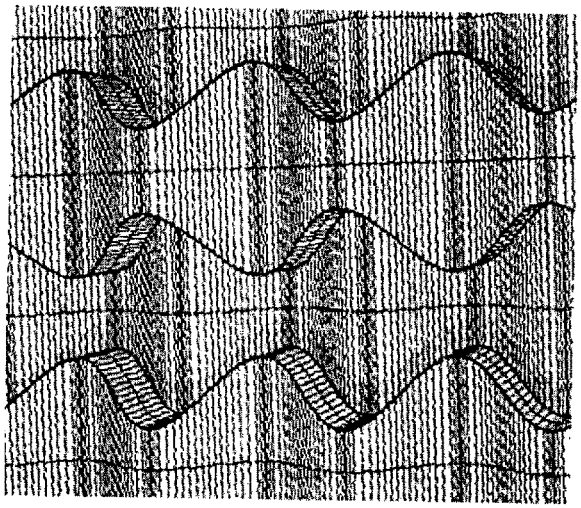
FIG. 11 is an illustration of an embodiment where the discs above and below the sheet all oscillate in parallel.
Figure 12:
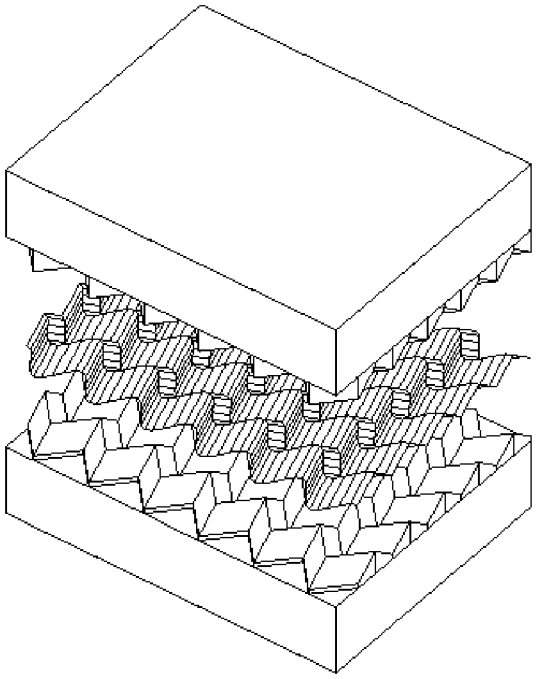
FIG. 12 is an illustration of a sheet material produced by a method where the discs oscillate synchronously turning alternately in opposite directions.

Various oscillating disc patterns will produce various materials. In the simplest case, the discs above and below the sheet all oscillate in parallel. FIG. 11 is a folded sheet producible by this process. A synchronized oscillation with discs turning alternately in opposite direction may produce materials similar to the folded sheet shown in FIG. 12. Both figures may be used as a preliminary form to be further processed, and with CNC oscillating discs this would give the added advantage of minimizing the retooling required for multiple patterns.

This machine continuously produces zero-curvature or near zero curvature materials. The surface is selected. The contraction ratio is calculated. The sheet material may be prepared to stretch laterally. The material is pre-gathered so that the combined effects of the pre-gathering and the lateral stretching give the intrinsic width of selected surface, and the projected width of the pre-gathered sheet equals the projected width of the final structure. Instead of using two or more rollers as I) above or one or more rollers as II) above, an articulating rack of formers (discs) oscillates back and forth. The formers may be sharp edged or not, and may be backed by rubber or other material rollers, which may be smooth cylinders, with preferably oscillating mechanisms. This may produce a sine wave type pattern, or other patterns of the same or various convexity sequences. In some cases, the produced pattern is the desired pattern, in other cases it is a "roughing out" that is then followed by patterned rollers, patterned dies, articulating devices or other.

One advantage is that each wheel and its backing may provide positive grip on the sheet material with steering capacity relative to the intrinsic sheet geometry. This gives added control. For instance, chevron-type patterns with row ridges separated substantially are problematic for the state of the art machines, because the pattern's ridge folds do not nest and interlock and the conventional patterned roller is defeated by a muted DPF pattern. Here each wheel may grip and steers in a zig-zag pattern, and the space between neighboring ridge chains assists in formation. It may also be desired for producing sharp corners in the formed pattern to use wheels with a zig-zag circumferential profile with as little as one period per revolution on the disc. These may oscillate in parallel. The backing rollers may oscillate in parallel. Another advantage is that the same machine will be capable of producing patterns with a variety of proportions by changing the oscillation rates.

IV. Continuous Lateral-Stretch Processes for Producing Zero-Curvature or Nearly Zero-Curvature Structures For many reasons the zero-curvature or nearly zero-curvature structures are valuable, even if they are produced by a process that involves some stretching. Each material has a maximum strain rate before it will fail, and generally it is preferred to stay within this strain rate. The procedure has many variations. A preferred embodiment is as follows:

1. Sheet material may be prepared to have a usable lateral ability to stretch. It may be prepared already on the roll, or while the sheet is moving in a preliminary production stage.
2. The material may be pre-gathered partially or not at all so that by combining the effect of the contraction ratio with the allowable lateral stretch will give a sheet of proper width for the final produced zero-curvature [or nearly zero-curvature] structure.
3. The sheet may be fed through a forming procedure that imparts the geometry on the sheet. This may involve a pair patterned roller, a pair of dies, articulating devices or other. This may be a sequence of forming steps as described above.

In one preferred embodiment, a desired zero-curvature surface is selected. Sheet metal of the same projected width on a roll is fed continuously through a slitting machine. The slits run longitudinally. The sheet is planned to stretch laterally to form a wider sheet of expanded metal with the same intrinsic width of the selected zero-curvature surface. In this situation, no pre-gathering is needed because the sheet will expand the full amount. The sheet is fed through patterned rollers. Inside the rollers the sheet expands laterally, while contracting longitudinally, so the projected image goes into the rollers faster than it comes out. The same slitting procedure works for paper and other materials.

In another preferred embodiment, cloth may be used with diagonally running fibers, so that the bias accomplishes the same effect. The cloth may be pre-gathered partially to add to the lateral width requirement of the selected zero-curvature surface. This would be helpful for cloths with matrix binders or other added ingredients, and in other cases where the bias does not expand easily to accommodate the full contraction ratio. The final forming rollers stretch the sheet tightly, and this eliminates wrinkles or other defects.

Annealed or plastic metals may be used. If needed some pre-gathering may augment the plasticity of the metal. The final forming rollers stretch the sheet tightly, and this eliminates wrinkles or other defects. Plastics and polymers generally admit great deformation before failing. These sheets may be prepared by warming them or adding plasticizers. Paper does not stretch very much. But by planning the pre-gathering so that the sheet will still need to stretch within its limit, would stretch the sheet tightly, and eliminate wrinkles or other defects.

Paper may be treated so that it does stretch. This may be similar to crepe paper. This may be accomplished by aligning and orienting the fibers to facilitate lateral strain. Additional fibers with greater elasticity may be mixed in. The paper may be wetted with water or other liquid. Elastic polymers may be added. The paper may be embossed with a texture to make it stretchable. Combinations of these methods and/or others may be employed. Once prepared to have a desired lateral capacity to stretch, pre-gathering may be employed as needed for the next step. The sheet is then processed through rollers, dies, or other means to produce the zero or near zero curvature surface.

For very fine patterns, it may be preferred to use an incremental stamp. This is related to the difficulty in using rollers with many circumferential periods.

These examples show many ways the material may be prepared to accommodate lateral deformation. The final creases may be imparted into the material by a pair of rollers, a sequence of rollers as above, by dies, by articulating devices, etc. Because the material is programmed to stretch laterally, it is pulled tight when the creases are formed and this improves the quality of the surface.

One way to understand the process is that a rectangular length of sheet after it is formed into a zero-curvature surface by this process, up to errors caused by the memory along the fold creases, if flattened or unfolded would be wider than it was before it was formed into the zero-curvature surface, and generally but not always the formed rectangle if flattened or unfolded would be shorter than the pre-formed rectangle. In contrast, the no-stretch folding procedures the rectangles would be the same size, up to errors caused by the memory along the fold creases.

V. Die Geometry

As mentioned above, it is advantageous to convert from pre-gathered corrugation type material to zero or near zero curvature surfaces by imparting the geometry in a series of steps. As the tessellation crease pattern on the smooth corrugation contracts longitudinally during formation, the steps should incrementally shorten longitudinally so that the crease vertices move minimally relative to the intrinsic sheet. Exact dies may be designed using our algorithms, or by an experimental method explained as follows.

A sheet marked with the desired sheet tessellation is formed into the desired surface on one end, and held in corrugation profile in the other end. The profile was calculated to have the correct contraction ratio in conjunction with the planned lateral stretching if any. It is preferred that the lateral periods of the corrugation and the tessellation have ratio 1:1, 2:1, 3:1, 3:2, or 4:1, but irregular frequencies may produce results as well. In the projection the tessellation is distorted from the final pattern's projection primarily by being longer longitudinally on the corrugation.

The die is designed by successively indenting on the tessellation crease lines, gradually more towards the folded end, with the correct convexity from above or below. Precise design depends on the frequency ratio, but generally the points on the surface furthest from their lateral position are pushed first, with ample space between the mating dies, and incrementally the sheet pattern transforms from the undifferentiated shape or the tessellation on the corrugation to the pronounced shape of the tessellation on the final patterned surface. With this progression, the period length changes and the spacing between the dies may lessen. The final incremental die form may have little or no excess space in the die pair.

All publications cited in the specification, both patent publications and non-patent publications, are indicative of the level of skill of those skilled in the art to which this invention pertains. All these publications are herein fully incorporated by reference to the same extent as if each individual publication were specifically and individually indicated as being incorporated by reference.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims.

What is claimed is:

1. A method of manufacturing a folded structure from flat sheet material, said method comprising:

pre-gathering the material laterally to produce longitudinal creases in the sheet material;

feeding the pre-gathered material through a set of oscillating discs in a first direction, wherein each of the discs is configured to rotate about a center axis of the disc while oscillating by translating in a second direction transverse to the longitudinal creases; and each of the discs is further configured so that the center axis of the disk oscillates by rotating in a plane extending in the first and second directions to yield a folded sheet with multiple non-parallel fold creases.

2. The method of claim 1, wherein the longitudinally-creased sheet material is fed through two oppositely facing sets of oscillating discs.

3. The method of claim 1, said method further comprising the step of: feeding sheet material through a set of patterned rollers.

* * * * *